United States Patent [19]

Bagnetto, Jr.

[11] 4,325,708

[45] Apr. 20, 1982

[54] FUEL DETERGENT COMPOSITIONS CONTAINING LUBRICATING OIL

[75] Inventor: Lucien J. Bagnetto, Jr., Bartlesville, Okla.

[73] Assignee: Phillips Petroleum Company, Bartlesville, Okla.

[21] Appl. No.: 832,057

[22] Filed: Sep. 9, 1977

[51] Int. Cl.[3] ..... C10L 1/22

[52] U.S. Cl. ..... 44/58; 44/66

[58] Field of Search ..... 44/58, 66, 71

[56] References Cited

U.S. PATENT DOCUMENTS

| | | | |
|---|---|---|---|
| 2,329,086 | 9/1943 | Robinson et al. | 260/401 |
| 3,223,495 | 12/1965 | Calvino et al. | 44/71 |
| 3,390,086 | 6/1968 | O'Halloran | 44/71 |
| 3,443,918 | 5/1969 | Kautsky et al. | 44/63 |
| 3,717,446 | 2/1973 | Howland | 44/58 |

*Primary Examiner*—Winston A. Douglas
*Assistant Examiner*—Y. Harris Smith

[57] ABSTRACT

A motor fuel additive composition comprising a fuel detergent composition and a lubricating oil. In preferred embodiments aminosuccinimide and amide-sulfonate fuel additive compositions are combined with lubricating oil in a fuel composition which exhibits reduced formation of engine deposits, particularly under additive-overdose conditions.

6 Claims, No Drawings

FUEL DETERGENT COMPOSITIONS CONTAINING LUBRICATING OIL

BACKGROUND OF THE INVENTION

This invention relates to motor fuel additive compositions. In one of its aspects this invention relates to improved operation of internal combustion engines. In another of its aspects this invention relates to reduction of formation of deposits in internal combustion engines. In yet another of its aspects this invention relates to the alleviation of the effects of overdosing of fuels with detergent additives.

The thermal stability of motor fuel compositions is becoming increasingly important as modern engines are forced to operate at higher and higher temperatures because the engines must use pollution-control devices. Fuels of low thermal stability can contain additives which during exposure to conditions of high temperature result in undesirable deposits in the carburetor, intake system, valves, etc. The stability problem is particularly acute in situations where overdoses of certain additives, especially carburetor detergents, are inadvertantly added to the motor fuel compositions. The use of such overdosed fuels in an internal combustion engine can cause the formation of excessive deposits in critical parts of the engine which results in severe engine damage, such as stuck valves and bent pushrods.

It is therefore an object of this invention to provide motor fuel additive compositions and motor fuel compositions containing these additives which alleviate the effects of thermal instability compared to prior art motor fuel compositions. It is another object of this invention to prevent damage to internal combustion engines resulting from overdosage of certain carburetor detergents in motor fuels.

Other aspects, objects, and the various advantages of this invention will become apparent upon reading this specification and the appended claims.

STATEMENT OF THE INVENTION

This invention provides a motor fuel composition which exhibits reduced formation of deposits, particularly under additive-overdose conditions, by the inclusion of a lubricating oil in the motor fuel composition containing detergent compositions. The detergent and lubricating oil can be added to the fuel composition either separately or in a preformed additive package or concentrate.

The lubricating oil which is suitable for use in the present invention is a solvent-refined, substantially paraffinic lubricating oil, generally having viscosity of 100 to 4500 SUS at 100° F. (38° C.) such as that obtained as the lubricating oil fraction of a Mid-Continent crude oil. Such an oil will have a paraffin content of at least about 55 volume percent and a naphthenes content of less than about 35 volume percent. Particularly suitable is a Mid-Continent solvent-refined paraffinic neutral oil having a viscosity of about 300 to 325 SUS at 100° F. (38° C.), which is suitable for formulation into lubricating oils of SAE-20 weight.

The fuels employed are compositions comprising straight chain paraffins, branched chain paraffins, olefins, aromatic hydrocarbons and naphthenic hydrocarbons. These fuels will generally have initial boiling points of about 21° C. and final boiling points of about 232° C. (ASTM D-86). The specifications for conventional gasolines are set forth in ASTM D-439-70. The fuel components can be derived by any of the conventional refining and blending processes, such as straight run distillation, thermal cracking, hydrocracking, catalytic cracking and various reforming processes. Synthetic fuels are also included. A motor fuel particularly suitable for use with the additive system of this invention is an essentially unleaded fuel which boils in the conventional motor fuel range of from about 21° C. to about 232° C.

The carburetor detergents employed in the inventive motor fuel compositions are generally of two major classes. The first class contains those compounds usually referred to as aminosuccinimides which correspond to the following formula:

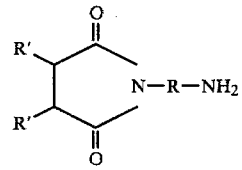

wherein R is a linear or branched alkylene radical containing from 1 to about 50, and preferably 5 to 25, carbon atoms per radical and wherein the R' groups are the same or different and are hydrogen or linear or branched alkyl groups containing from 1 to about 50 carbon atoms per group with the further proviso that the total number of carbon atoms in the R and R' groups is in the range of about 10 to 100, and preferably 20 to 50, carbon atoms. It is preferred that the one R' group is hydrogen while the other R' group contains 5 to 25 carbon atoms.

The above-defined R' groups can be relatively simple, readily-defined radicals, such as methyl, ethyl, isopropyl, t-butyl, n-hexyl, 4-ethyloctyl, 2,3,5,7-tetramethyl-n-decyl, n-stearly, n-eicosyl and corresponding divalent groups are representative of the R radicals. The R and R' groups can also be less readily-defined groups such as those derived from petroleum fractions or from cracked polymers, such as cracked polypropylene.

Compounds of this formula can be prepared by any means well-known in the art, such as by the direct reaction of the appropriately substituted succinic acid or succinic anhydride with diamines of general formula $H_2N—R—NH_2$.

The other class of carburetor detergents useful in the motor fuel compositions of the present invention are those reaction products referred to as amide-sulfonates which are prepared by reaction of at least one long chain monocarboxylic acid or ester with at least one multi-amine to produce an amide or mixture of amides and subsequent treatment of the amide or mixture of amides with a sulfonic acid.

The long chain monocarboxylic acids useful in preparing the above-described amide-sulfonates are those of general formula R''COOH wherein R'' is either linear or branched long chain aliphatic or aromatically-substituted aliphatic radical having from about 10 to about 30 carbon atoms. Representative acids include neodecanoic acid, stearic acid, oleic acid, dodecanoic acid, isostearic acid and phenyl stearic acid. Mixtures of acids can also be employed such as tall oil acids and those acids derived from the saponification of fats and oils such as cottonseed oil, saffron oil, peanut oil, soybean oil, coconut oil, etc.

Esters of the above-described long chain monocarboxylic acids with mono- or polyhydric alcohols can also be employed in the preparation of above-described amide-sulfonates. The alcohol moiety of the esters can be derived from simple monohydric alcohols, such as methanol, ethanol, isopropanol, n-hexanol, etc., or from polyhydric alcohols such as ethylene glycol, glycerol, pentaerythritol, etc. It is likewise possible to employ fats and oils which contain these esters or mixtures of esters. Such fats and oils include cottonseed oil, saffron oil, peanut oil, corn oil, soybean oil, coconut oil, etc.

The multi-amines employed in the amide-sulfonate preparation are those having at least 2, and preferably 3 or more, amine groups per molecule. Said multi-amines are represented by generic formulas $N(R'''NH_2)_3$ and $H_2N—(CH_2CH_2NH)_xH$ wherein R''' is an aliphatic radical having 1 to 6 carbon atoms and x is an integer having the value of from 1 to about 100, and preferably 3 to 10. Typical examples of the former multi-amine include tris(aminomethyl) amine, tris-(2-aminoethyl) amine, tris-(4-amino-2-methylbutyl) amine and 2-aminoethyl-bis-(3-aminopropyl) amine. Typical examples of the latter multi-amine are ethylene diamine, triethylenetetramine, tetraethylenepentamine, hexaethyleneheptamine and the like. Mixtures of the above-described multi-amines may also be employed.

The sulfonic acids which are employed in the preparation of the amide-sulfonate are broadly represented by the generic formula R'''' $SO_3H$ wherein R'''' is an aliphatic, cycloaliphatic or alkaryl radical having 12 to 30 carbon atoms. Representative acids include dodecylbenzenesulfonic acid, stearylsulfonic acid, oleylsulfonic acid, heptadecylbenzenesulfonic acid, and the like. Mixtures of sulfonic acids as produced by the sulfonation of white oils and other petroleum fractions commonly known as petroleum sulfonic acids or "mahogany" acids can also be used. The preferred average molecular weight range of these acid mixtures is between 200 and 1000.

The initial reaction of the multi-amine and monocarboxylic acid or ester is carried out using a conventional stirred apparatus with a solvent, if desired, selected from xylenes or petroleum naphtha at a temperature in the range of 150° to 177° C., preferably at solvent reflux temperature, for a period of 6 to 8 hours. At least one-half equivalent of monocarboxylic acid or ester is employed per equivalent of multi-amine. Preferably two or more of the primary or secondary amine groups present in the multi-amine molecule react with the acid or ester groups. In the case of the amines represented by $N(R'''NH_2)_3$ at least two and preferably all three primary amine groups are allowed to react with the monocarboxylic acid or ester.

The product of initial reaction of the multi-amine and monocarboxylic acid or ester is then treated with the above-described sulfonic acid to produce the desired amide-sulfonate. At least one residual amine group is treated to incorporate at least one equivalent of the sulfonic acid in the molecule.

The additive package of the present invention comprises the detergent and lubricating oil in amounts generally corresponding to about 50 to about 80 percent by weight of the above-described detergents and about 20 to about 50 percent by weight of lubricating oil.

In addition to the detergent and lubricating oil the motor fuel or the preformed additive concentrate can contain other conventional additives such as demulsifying agent, antioxidants, rust inhibitors, colorants, anti-freeze agents, and the like. The preformed packaged can also contain, if desired, suitable hydrocarbon diluents or solvents in order to solubilize the ingredients and improve the handling ease.

The additive package containing detergent and lubricating oil is normally employed in the inventive motor fuel compositions in amounts corresponding to 3 to 215 and preferably 28 to 143 gm/m$^3$ (1 to 75 and 10 to 50 pounds per 1000 barrels) of fuel composition. However, in the event of inadvertant overdosages, the amount of additive package in the fuel can reach 12 kg/m$^3$ or even higher.

Inadvertant overdosages of some carburetor detergents have been observed in the past to result in severe engine damage, particularly to the valve train. Such overdoses can be the result of mechanical malfunction or human error during the blending operation in which the additives are mixed with the fuel compositions. Because of the relatively small amounts of additive as compared to the fuel composition and the large amounts of fuel involved in blending operations, these occasional, inadvertant overdosages frequently go undetected. Potentially, large numbers of engines, such as automobile engines, can be afflicted with resultant gummy and sticky deposits which can cause damage to the engines. The present invention provides a motor fuel composition with good thermal stability to function efficiently and provide adequate detergency under conditions of normal additive dosage and also to protect the engine from damage resulting from inadvertant overdosages of the additive package.

EXAMPLE I

The following inventive Run 3 illustrates the detergency properties of an inventive motor fuel composition containing a commercial aminosuccinimide detergent and a lubricating oil. Comparative runs employing neither detergent nor oil (Run 1) and detergent but no oil (Run 2) are provided for comparison purposes.

The commercial additive package used, 577-B manufactured by Amoco, contained about 80 percent by weight aminosuccinimide of about 530 molecular weight, about 20 percent by weight aromatic solvent and about 1–2 percent by weight of a demulsifying agent an ethyleneoxy polyphenol such as described in U.S. Pat. No. 3,752,657.

The lubricating oil employed in inventive Run 3 is identified as KC-20 stock, a raw lubricating oil for blending purposes which conforms to the specifications for an SAE-20 grade oil, properties of which are given in Table I.

TABLE I

| Properties of KC-20 Stock Oil | |
|---|---|
| Density at 20° C. | 0.8768 |
| Refractive index | 1.4845 |
| Mol. wt. (osmometer) | 451 |
| Mol. wt. (GPC) | 424 |
| Viscosity at temp, SUS | |
| 100° F. (38° C.) | 310.1 |
| 210° F. (99° C.) | 53.41 |
| 350° F. (177° C.) | 34.50 |
| 400° F. (204.5° C.) | 32.52 |
| Viscosity index | 101 |
| Hydrocarbon content, wt. % | |
| Aromatics | 6 |
| Naphthenes | 29 |
| Paraffins | 65 |

The motor fuel employed was a nonleaded gasoline boiling between 21° C. and 232° C. containing no additives.

The carburetor detergency test employed to evaluate the inventive and comparative motor fuel compositions involved the use of test gasolines in a 170 cubic inch displacement 6 cylinder automobile engine with a removable carburetor throat insert. Operation of the engine was for 23 continuous hours at 1,800 rpm and 11.4 brake horsepower. Weighing the removable insert after these conditions of operation gave the weight of deposits formed. The weight of deposits was determined both before and after washing the insert with n-heptane.

Table II gives the results of the above-described detergency tests.

TABLE II

| Run No. | Additive, gm/m³(ptb[4]) solvent[1] | detergent | oil | Deposits, mg Unwashed | Washed |
|---|---|---|---|---|---|
| 1(comp.) | none | none | none | 29.0[2] | 27.4[2] |
| 2(comp.) | 21.4(7.5) | 28.6(10) | none | 19.2[2] | 17.8[2] |
| 3 | 32.8(11.5) | 25.4(8.9) | 16.9(5.9) | 19.0[3] | 17.3[3] |

[1]Mixed stream of predominantly $C_9$ aromatics.
[2]Average of 4 determinations.
[3]Single determinations.
[4]Pounds per 1000 barrels of fuel composition.

The data in Table II illustrate that the addition of inventive additives to a motor fuel improves significantly the detergency of the fuel composition over the fuel without additives. In detergency the inventive package is as good as the commercial additive package.

EXAMPLE II

The following runs illustrate the use of amide-sulfonates and lubricating oil in motor fuel compositions.

Neodecanoic acid, phenylstearic acid and tetraethylenepentamine (1/1/1 molar ratio) were mixed in a stirred reactor which was then heated to 175° C. with a nitrogen stream bubbling through the reaction mixture. After 8 hours under these reaction conditions the mixture was cooled to about 25° C. after which petroleum sulfonic acid (0.75 mole) and KC-20 stock lubricating oil—20 percent by weight of total mixture—were added. After 0.5 hour at 55° C., the reaction mixture was discharged from the reactor for use in the motor fuel described in Example I. The carburetor detergency test employed in Example I was used to test the detergency characteristics of the inventive composition of this example.

The test results are given in Table III. In Runs 5 and 6, additional KC-20 stock oil was added to the additive package to investigate the dilution effect of the oil.

TABLE III

| Run No. | Additive, gm/m³(ptb) Amide sulfonate | oil | Deposits, Washed Reduction, %[1] |
|---|---|---|---|
| 4 | 45.7(16) | 11.4(4) | 75 |
| 5 | 40.0(14) | 17.1(6) | 77 |
| 6 | 34.3(12) | 22.8(8) | 76 |

[1]Percent reduction in washed deposits compared to fuel composition which utilized no additive.

The above data illustrate the effectiveness of that inventive composition as a carburetor detergent by showing a significant reduction in weight of carburetor deposits compared to a fuel without the inventive additive. The data in Table III also demonstrate that detergency is not reduced by substituting oil for part of the amide-sulfonate.

EXAMPLE III

The following runs illustrate the use of the vegetable oils such as soybean oil and coconut oil in the preparation of amide-sulfonates and the use of these oils with KC-20 lubricating oil at 20 percent by weight oil in total additive package in motor fuel compositions.

The amide-sulfonates of this example were prepared as generally described in Example II. Proportions of reactants and motor fuel composition components and also detergency characteristics of the fuel (as determined in Example I) are given in Table IV.

TABLE IV

| Run No. | Reactants | Mole Ratio | Additive gm/m³ (ptb) | Deposits, Washed Reduction, % |
|---|---|---|---|---|
| 7 | Soy/TEPA/PSA[1] | 1/1/0.6 | 28.6(10) | 62 |
| 8 | " | " | 57.1(20) | 87 |
| 9 | " | " | 85.7(30) | 91 |
| 10 | Coconut/TEPA/PSA[2] | 1/1/0.3 | 28.6(10) | 66 |
| 11 | " | " | 57.1(20) | 86 |
| 12 | " | " | 85.7(30) | 92 |

[1]Soybean oil/tetraethylenepentamine/petroleum sulfonic acid
[2]Coconut oil/tetraethylenepentamine/petroleum sulfonic acid The data in the Table IV illustrate the significant reduction in carburetor deposits obtained using motor fuel compositions containing the inventive additive package in various amounts when soybean oil and coconut oil were employed in preparation of the amide-sulfonates compared to motor fuel containing no additives.

EXAMPLE IV

The following runs illustrate the damage sustained by an automobile engine operated using fuel containing large amounts of the commerical additive described in Example I and also illustrate the significant improvement in engine operation using fuel containing large amounts of an inventive additive package containing that additive and KC-20 stock lubricating oil.

The engine tests were conducted employing a Ford V-8 302 cubic inch engine. A test cycle consisted of idling 5 minutes at 500 rpm and 2 brake horsepower load followed by running for 25 minutes at 2500 rpm and 87 brake horsepower and finally shutting the engine off and allowing it to cool for 120 minutes. The test cycle was repeated usually 6 or 7 times until 20 gallons (75.7 l) of fuel was consumed or until engine failure occurred. Engine test results are recorded in Table V.

TABLE V

| Run No. | Additive | Conc, kg/m³(ptb) | Cycles Completed | Result |
|---|---|---|---|---|
| 13(comp.) | A[9] | 2.28(800) | all | pass[1] |
| 14(comp.) | A[9] | 2.57(900) | all | fail[2] |
| 15(comp.) | A[9] | 2.86(1000) | 1 | fail[3] |
| 16(comp.) | A[9] | 5.71(2000) | 1 | fail[4] |
| 17 | A[9] | 9.14(3200) | 1 | fail[5] |
| | KC-20 | 2.28(800) | | |
| 18 | A[9] | 8.00(2800) | all | marg. pass[6] |
| | KC-20 | 3.43(1200) | | |
| 19 | A[9] | 6.85(2400) | all | marg. pass[7] |
| | KC-20 | 4.57(1600) | | |
| 20 | A[9] | 0.026(9) | all | pass[8] |

TABLE V-continued

| Run No. | Additive | Conc, kg/m³(ptb) | Cycles Completed | Result |
|---|---|---|---|---|
| | KC-20 | 0.0117(6) | | |

(1)During start of fourth cycle, puff-back through carburetor indicated improper valve action.
(2)Examination of intake valves showed two were stuck, three were very sluggish and one was sluggish.
(3)Six intake valves were stuck, one rocker arm stud was pulled.
(4)Six intake valves were stuck, five rocker arm studs were pulled, two push rods were bent.
(5)Of intake valves three were stuck and four were very sluggish, four bent push roods, one rocker arm stud was pulled.
(6)Marginal pass. Rough running second through seventh cycles. Of intake valves three were very, very sluggish, three were very sluggish and two were sluggish.
(7)Marginal pass. Of intake valves one was stuck, four were very sluggish and three were sluggish.
(8)Run 20 was run after a duplicate of Run 19 in which engine was not dismantled, examined and cleaned. After Run 20 examination of engine showed no damage-all intake valves operated freely.
(9)Additive was the commercial detergent used in Example I.

The data from comparative Runs 13 to 16 show that at amounts of commercial additive above about 2.3 kg/m³ (representative of inadvertant overdoses of additive in motor fuels) engine malfunction or damage occurred with consumption of 75 liters or less of the fuel composition. Inventive runs 17 to 19 demonstrated that even at about 10 kg/m³ of total inventive additive package engine damage or malfunction was less severe than when about 2.8 kg/m³ or more commercial additive was employed (Runs 15 and 16). Inventive Runs 17 to 19 also show that at about 10 kg/m³ dosage increasing the proportion of lubricating oil in the additive package from 20 to 40 weight percent of the total inventive additive package significantly improved the resulting condition of the engine compared to that resulting from even lesser amounts of the commercial additive above (Runs 14 to 16) even to the point that engine damage, if at all present, was minimal. Inventive Run 20 further shows that the deposits which accumulated in the engine during a duplicate of Run 19 were removed from the engine during the subsequent use of about 75 liters of fuel containing a representative normal amount of the inventive additive package.

EXAMPLE V

The following runs demonstrate that inventive additive packages based on amide-sulfonates and containing KC-20 lubricating oil and ethyleneoxy polyphenol demulsifier, as 1% of total additive package weight, when applied to fuel compositions in amounts representative of large overdoses do not result in significant engine damage during the consumption of 75 liters of overdosed fuel.

Table VI contains the ratio of reactants for preparation of amide-sulfonates, dosage and results of engine tests run as described in Example IV.

TABLE VI

| Run No. | Acid or Veg. Oil, Mole | TEPA,(1) Mole | PSA,(2) Mole | KC-20, %(3) | Dosage(4) kg/m³ (ptb) | Result |
|---|---|---|---|---|---|---|
| 21 | N,(5)1 P,(6)1 | 1 | 1 | 20 | 5.71(2000) | Pass(7) |
| 22 | N, 1 P, 1 | 1 | 1 | 20 | 11.4(4000) | Marg. pass(8) |
| 23 | S,(9)2 | 1 | 0.6 | 20 | 11.4(4000) | Pass(10) |
| 24 | S, 1 | 1 | 0.6 | 20 | 11.4(4000) | Pass(11) |

(1)Tetraethylenepentamine.
(2)Petroleum sulfonic acid.
(3)Weight percent of total additive package.
(4)Dosage of total additive package in fuel composition.
(5)Neodecanoic acid.
(6)Phenylstearic acid.
(7)No engine inspection. Engine operated normally during consumption of 75 liters of fuel.
(8)Intake system was not cleaned between Runs 21 and 22. After Run 22, seven intake valves were very sluggish, one was sluggish.
(9)Soybean oil.
(10)All intake valves free. No engine damage.
(11)Four slightly sluggish intake valves.

The above data demonstrate that under drastic overdose conditions inventive additive packages based on amide-sulfonates prepared using monocarboxylic acids or vegetable oils do not result in engine damage.

EXAMPLE VI

The following runs demonstrate the ability of the compositions of this invention to improve the thermal stability of fuels containing the inventive additive packages under drastic overdose conditions compared to fuels containing the detergents without additional lubricating oil.

A laboratory bench test was devised to test the fuel compositions without having to employ costly and time-consuming engine tests. In this test, a gasoline sample (20 ml) overdosed with additive package to the extent of 8.55 kg/m³ (3000 ptb) was placed in a flat-bottomed aluminum dish containing a smooth aluminum chip (12.7 mm×6.35 mm×3.17 mm) and heated at 213±2.8° (415±5° F.) for 30 minutes in air. Upon cooling, the aluminum chip was observed to be bonded to the aluminum dish by the resulting residue. The force required to break the bond was taken as a measure of the valve sticking tendency in an engine.

Results obtained employing fuels containing overdoses of the commercial additive package described in Example I and the amide-sulfonate described in Example II each with varying amounts of KC-20 lubricating oil are recorded in Table VII.

TABLE VII

| Run No. | Additive | Kg/m³ | Oil, kg/m³ | Force, gm |
|---|---|---|---|---|
| 25 | A(1) | 8.55 | none | >1134 |
| 26 | " | 6.84 | 1.71 | >1134 |
| 27 | " | 5.99 | 2.57 | 108 |
| 28 | " | 5.13 | 3.42 | 57 |
| 29 | Amide-sulfonate | 8.55 | none | >1134 |
| 30 | " | 6.84 | 1.71 | 652 |
| 31 | " | 5.99 | 2.57 | 57 |
| 32 | " | 5.13 | 3.42 | 28 |

(1)Additive was the commerical detergent used in Example I.

The data in Table VII demonstrate that the use of lubricating oil with the aminosuccinimide and amide-sulfonate detergents in overdose conditions drastically reduces the force required to loosen the aluminum chip bonded to the pan by the residue.

It is reasonable to relate this test to the conditions existing in a hot automobile engine, especially immediately after shutdown when the fuel composition would remain in contact with the intake valves. Evaporation of the fuel due to residual engine heat would leave a deposit similar to that described above around the valves, valve stems and valve guides. The above-described force can be readily related to the force applied during subsequent engine startup by the pushrods to move the valves coated with the deposits. Excessive binding forces on the valves due to the residue would result in sluggish and inefficient valve operation and, at the extreme, damage such as stuck valves and bent push rods. Hence the data in Table VII indicate that under severe overdose conditions the additive packages of this invention could be beneficial in automobile engines in significantly reducing the possibility and extent of damage to the engine.

EXAMPLE VII

The following runs demonstrate the use of lubricating oils other than the KC-20 stock oil described in Example I. The laboratory bench test described in Example VI, except as noted for additive concentrations, was employed to test the effect of these oils used in conjunction with the aminosuccinimide commercial additive package described in Example I under conditions of severe overdosage.

In Table VIII the test results employing lubricating oils of SAE-20, −50, and −250 weights are recorded.

TABLE VIII

| Run No. | A[1] kg/m$^3$ | Oil | kg/m$^3$ | Force, gm |
|---|---|---|---|---|
| 25 | 8.57 | | none | >1134 |
| 33 | 8.57 | 20 | 5.71 | 51 |
| 34 | 8.57 | 50 | 5.71 | 108 |
| 35 | 8.57 | 250 | 5.71 | 142 |

[1]Additive was the commercial detergent used in Example I.

The above data illustrate that lubricating oils with widely varying viscosities are useful in the inventive compositions for minimizing possible engine damage under conditions of severe additive overdosages.

I claim:

1. In combination (a) a motor fuel and (b) a fuel additive composition comprising (1) an amino succinimide fuel detergent and (2) a substantially paraffinic lubricating oil wherein the detergent composition is about 50 to about 80 percent by weight of the additive composition and the lubricating oil is about 50 to about 20 percent by weight of the additive composition wherein said total additive composition comprising detergent composition and lubricating oil is in an amount within a range of about 3 to about 215 g/m$^3$ of motor fuel.

2. In combination (a) a motor fuel and (b) a fuel additive composition comprising (1) an amide-sulfonate fuel detergent prepared by reaction of at least one long-chained carboxylic acid or ester with at least one multi-amine to prepare product which is subsequently reacted with a sulfonic acid and (2) a substantially paraffinic lubricating oil wherein the detergent composition is about 50 to about 80 percent by weight of the additive composition and the lubricating oil is about 50 to about 20 percent by weight of the additive composition wherein said total additive composition comprising detergent composition and lubricating oil is in an amount within a range of about 3 to about 215 g/m$^3$ of motor fuel.

3. A method for stabilizing a motor fuel composition said method comprising the addition of a fuel additive composition comprising (1) an amino succinimide fuel detergent and (2) a substantially paraffinic lubricating oil wherein the detergent composition is about 50 to about 80 percent by weight of the additive composition and the lubricating oil is about 50 to about 20 percent by weight of the additive composition wherein said total additive composition comprising detergent composition and lubricating oil is in an amount within the range of about 3 to about 215 g/m$^3$ of motor fuel to said motor fuel composition.

4. A method for stabilizing a motor fuel composition said method comprising the addition of a fuel additive composition comprising (1) an amide-sulfonate fuel detergent prepared by reaction of at least one long-chained carboxylic acid or ester with at least one multi-amine to prepare product which is subsequently reacted with a sulfonic acid and (2) a substantially paraffinic lubricating oil wherein the detergent composition is about 50 to about 80 percent by weight of the additive composition and the lubricating oil is about 50 to about 20 percent by weight of the additive composition wherein said total additive composition comprising detergent composition and lubricating oil is in an amount within a range of about 3 to about 215 g/m$^3$ of motor fuel to said motor fuel composition.

5. A method for alleviating the effects of thermal instability of a motor fuel composition comprising an aminosuccinimide or amide-sulfonate fuel detergent, said method comprising the addition of sufficient lubricating oil to said motor fuel composition to obtain a total additive composition comprising detergent composition and lubricating oil in an amount within the range of about 3 to about 215 g/m$^3$ of motor fuel.

6. A method for alleviating the effects of overdosage of a motor fuel with a detergent composition comprising combining detergent composition on addition to the motor fuel with a lubricating oil to form a fuel additive composition that contains detergent additive in an amount that is about 50 to about 80 percent by weight of the additive in an amount that is about 50 to about 80 percent by weight of the additive composition and contains lubricating oil in an amount that is about 50 to about 20 percent by weight of the additive composition wherein said total additive composition comprising detergent composition and lubricating oil is in an amount within the range of about 3 to about 215 g/m$^3$ of motor fuel.

* * * * *